US005738737A

United States Patent [19]

Ayers

[11] Patent Number: 5,738,737

[45] Date of Patent: Apr. 14, 1998

[54] PROCESS FOR MAKING SUPERPLASTIC STEEL POWDER AND FLAKES

[75] Inventor: Jack D. Ayers, Oakton, Va.

[73] Assignee: The United States of America as represented by the Secretary of the Navy, Washington, D.C.

[21] Appl. No.: 787,994

[22] Filed: Nov. 5, 1991

[51] Int. Cl.[6] ..... C21D 10/00

[52] U.S. Cl. ..... 148/564; 148/513; 148/514; 148/540; 148/543; 148/548; 148/320; 148/404

[58] Field of Search ..... 148/320, 404, 148/513, 514, 540, 543, 548, 564; 75/238, 239, 240, 241, 255, 343, 352

[56] References Cited

U.S. PATENT DOCUMENTS 4,297,135 10/1981 Giessen et al. ..... 148/330
4,448,613 5/1984 Sherby et al. ..... 148/653

OTHER PUBLICATIONS

Sherby et al., "Ultrahigh Carbon Steels," Journal of Metals, Jun. 1985, pp. 50–56.

*Primary Examiner*—Sikyin Ip
*Attorney, Agent, or Firm*—Thomas E. McDonnell; Barry A. Edelberg

[57] ABSTRACT

In a process for making superplastic steel powder or flakes, molten steel is rapidly solidified to form a solidified material comprising substantially single-phase austenitic steel powder or flakes having a grain size of no greater than about 2 μm. The powder or flakes are heated at a temperature of 300° C. to 600° C. to produce superplastic steel comprising a mixture of ferrite steel and at least one metal carbide, the ferrite steel having a randomly oriented structure and having a grain size of no greater than about 2 μm, the at least one metal carbide having a grain size no greater than about 0.5 μm. The steel powder or flake is then recovered for further processing. A consolidated superplastic steel can be formed from the powder or flake by hot pressing the powder or flake at a temperature of between about 650° C. and about 950° C. and at a pressure of about 10 MPa to about 100 MPa for a time sufficient to form a fully dense consolidate.

15 Claims, No Drawings

PROCESS FOR MAKING SUPERPLASTIC STEEL POWDER AND FLAKES

BACKGROUND OF THE INVENTION

1. Field of the Invention

The present invention relates to the production of superplastic steel powder and flakes.

2. Prior Art

Powder processing of metals is widely employed in industry to form parts of near-final shape. The most widely employed processing method employs cold pressing of the metal powder into a low strength compact which must then be sintered at an elevated temperature to consolidate it to full density. The parts so formed generally have lower strength levels than wrought parts, because the high temperature processing limits the strength which can be achieved. The parts so made are also less than optimal, because they shrink as the powder is sintered, and this shrinking is nonisotropic so the dimensions can not be as closely controlled as is desired. It has long been recognized that many of the shortcomings of powder metallurgy processing could be overcome through the use of superplastic metal powders, and many experiments have been done—especially with nickel and titanium based alloy powders. A limited number of experiments have been done with steels, but there has not yet been any method reported for producing steel powder which can be superplastically deformed at the high rates desired. Powders experimented with to date have contained coarse phases which limit the rate at which they will flow to such an extent that their consolidation under pressure proceeds too slowly to satisfy industrial needs.

In the case of alloys, it is known to produce superplastic structures by repeatedly cycling the alloy through a temperature at which the alloy transforms from one crystalline structure to another. However, this method is inefficient and causes undesirable bonding of the powder particles to one another.

Superplasticity has also been induced in certain alloys by solidifying the alloys at rapid rates so as to put the alloys in an amorphous form, and by then crystallizing the alloys at a temperature which generates a stable, very fine grained two phase structure. However, this approach in not totally satisfactory, because few steels of commercial interest can be made amorphous by practical means.

SUMMARY OF THE INVENTION

It is an object of the invention to produce superplastic steel from a steel powder at a high rate of speed.

It is another object of the invention to produce high quality steel from a steel powder.

It is another object to produce superplastic steels from a variety of different types of alloys.

The present invention provides a process for making superplastic steel powder or flakes comprising:

rapidly solidifying molten steel to form a solidified material in the form of powder or flake comprising substantially single-phase austenitic steel having a grain size of no greater than about 2 μm;

heating the powder or flakes at a temperature of 300° C. to 600° C. to produce superplastic steel powder or flakes comprising a mixture of ferrite steel and at least one metal carbide, the ferrite steel having a randomly oriented structure and having a grain size of no greater than about 2 μm, and at least one metal carbide having a grain size no greater than about 0.5 μm; and recovering the superplastic steel powder or flakes.

The present invention also provides a process for making consolidated superplastic steel comprising:

rapidly solidifying molten steel to form a solidified material in the form of powder or flake comprising substantially single-phase austenitic steel having a grain size of no greater than about 2 μm;

hot pressing the solidified material at a temperature of between about 650° C. and about 850° C. and at a pressure of about 10 MPa to about 100 MPa for a time sufficient to form a consolidated superplastic steel comprising a mixture of ferrite steel and at least one metal carbide, the ferrite steel having a randomly oriented structure and having a grain size of no greater than about 2 μm, the at least one metal carbide having a grain size no greater than about 0.5 μm; and recovering the consolidated superplastic steel.

Another embodiment of the invention is a process for making a composite steel product, comprising:

rapidly solidifying molten steel to form a solidified material in the form of powder or flake comprising substantially single-phase austenitic steel having a grain size no larger than about 2 μm;

heating the powder or flakes at a temperature of 300° C. to 600° C. to produce superplastic steel powder or flakes comprising a mixture of ferrite steel and at least one metal carbide, the ferrite steel having a randomly oriented structure and having a grain size of no greater than about 2 μm, and at least one metal carbide having a grain size no greater than about 0.5 μm;

hot pressing the power or flake onto a metal blank at a temperature of between about 650° C. and about 850° C. and at a pressure of about 10 MPa to about 100 MPa for a time sufficient to bond the coating material to the blank to form a composite steel product, recovering the composite steel product.

DETAILED DESCRIPTION OF THE INVENTION

Steels have been produced which will deform at the desired rates but these have not been produced in the form of powder or flake as required for powder metallurgy processing. These steels have been produced by deforming steel at elevated temperatures so as to break up or prevent the formation of coarse phases which limit the superplastic flow rate. Studies have shown that ultrahigh carbon steels can be processed by these means in such a way as to produce microstructures consisting of ferrite (body center cubic structure iron alloy) with grain sizes of about one micrometer containing particles of a metal carbide, preferably cementite (an iron carbide) of sub-micrometer sizes. Steels with these microstructures will deform superplastically at appropriate temperatures. When the steels are alloyed with elements which stabilize the fine ferrite/metal carbide structures at temperatures in the vicinity of 800° C., deformation rates can approach 100 percent per minute. Further work has shown that these steels bond well to themselves and to other steels when they are pressed together at temperatures where they deform superplastically. All of these observations demonstrate that when powder or flake are produced with the types of structure just described, then they can be easily consolidated in such a way as to achieve the objectives of the present invention.

The objectives of the present invention are made possible by the discovery of a method for producing powder or flake of a steel alloy of appropriate composition with a fine ferrite/metal carbide structure. This can be done in a simple and economic fashion by a process which is applicable to a wide range of alloy compositions and which does not require any mechanical deformation of the powder. The inventors have discovered that the fine ferrite/metal carbide structures can be produced by simple heat treatments of particles with initial structures consisting of single phase, fine grain austenite (face centered cubic iron alloy) containing appropriate amounts of carbon and possibly other desirable alloying additions.

It is not necessary that the austenite persist at any particular temperature for a prescribed time, only that it exist for a long enough time for the desired fine ferrite/metal carbide structure to be produced from it. It is, however, preferred not only that the austenite be produced, but that it have a fine enough grain size so that when it is transformed to a mixture of ferrite and metal carbide, the two phase mixture has the desired fine scale structure. The fine two phase mixture can be produced from the austenite by any of several different reaction mechanism, but for some alloys the initial stages, at least, will occur by tempering martensite (metastable body centered tetragonal iron alloy formed from austenite by a shear transformation) produced during initial cooling of the austenite after it is formed from the melt. If the ferrite forms from martensite, its grain size will be related to and generally somewhat smaller than the martensite platelet size. The maximum martensite platelet dimension will normally correspond to the dimension of the austenite grains in the plane of the platelet. If the ferrite forms by some other mechanism, its grain size will be related to and somewhat smaller than the austenite grain size. In either event, it is important that the austenite grain size be small enough that the mean ferrite grain size be no more than a few micrometers, and preferably that it be no more than one or two micrometers. It is therefore necessary that the austenite grain size be no more than a few micrometers. Such austenite grain sizes can be produced by rapid solidification processing (RSP).

Single phase austenite has been produced through rapid solidification processes by many different investigators, but none of them have realized that producing such a phase in fine grain sizes and in alloys of appropriate compositions is important to achieving the objectives stated above. It is relatively easy to produce single phase austenite by RSP, for any alloy containing a modest amount of any of several alloying additions. In general terms, more rapid solidification rates will generate finer austenite grain sizes.

One method of producing a rapidly solidified material is by gas atomization. A suitable gas atomization process to produce a fine grain solidified material is described in U.S. Pat. No. 4,619,845, the entire disclosure and contents of which is hereby incorporated by reference. In a gas atomization process, liquid metal is fed to a nozzle where a gas stream atomizes the metal into droplets which solidify into powder particles. Gas atomized powders generally have mean particle sizes on the order of one hundred micrometers, and the as-solidified grain size is usually comparable to or somewhat smaller than the particle size. These particles solidify at rates in the range of about $10^3$ to $10^5$ °/sec. Finer powders cool faster and have finer grain sizes, but uniformly fine grain sizes as small as a few micrometers are difficult to produce by gas atomization.

Another method of producing a fine grained rapidly solidified material is by water atomization. Such a process for making fine grained copper alloys is described in U.S. Pat. No. 4,170,466, the entire disclosure of which is hereby incorporated by reference. More generally, the water atomization of metal alloys is described in U.S. Pat. No. 2,956,304, the entire disclosure of which is hereby incorporated by reference.

Another method of rapid solidification that may be used in the process of the invention is chill block melt spinning. A suitable chill block melt spinning process is described in U.S. Pat. No. 4,221,257, the entire disclosure and contents of which is hereby incorporated by reference. In chill block melt spinning, metal strips foil, or flakes are formed by forcing molten metal onto the surface of a moving chill body under pressure through a nozzle.

Alloys solidified in the form of thin ribbon, foil, or flake by chill block melt spinning can have cooling rates in the range of $10^5$ or $10^6$ °/sec, and austenitic alloys prepared in this way often have columnar microstructures consisting of many nearly parallel grains oriented with their axes nearly vertical to the plane of the quenched foil. The diameters of these grains are generally in the range of one to 10 micrometers and their lengths generally correspond approximately to the foil thickness. This thickness is normally about 20 to 200 micrometers. Ferrite/cementite mixtures produced from such grains will normally have ferrite grain sizes smaller than columnar austenite grain diameters because at low, preferred transformation temperatures, few ferrite precipitates will have the opportunity to grow more than half this diameter before encountering another growing ferrite grain. If the initial transformation product is martensite, some of the martensite plates will grow along the columnar austenite grains, and these might then have one long dimension. Ferrite formed from these long martensite plates will impede superplastic flow, but are few in number and, therefore, do not present a serious problem.

The rapidly solidified material consists of powder or flakes of a single phase, fine grained austenitic steel. If the initial solidified material is a powder of sufficiently fine grain size, then it requires only a simple heat treatment and hot pressing to form the desired dense parts. If the initial solidification product is a foil, it can be comminuted to a powder or flake. Heat treatment of the powder or flake at a temperature below that at which austenite first transforms to ferrite on slow cooling (the Al temperature) will produce the desired ferrite/cementite mixture. Preferably, the ferrite/cementite mixture is about 10 to 30% cementite by volume. If the percentage of cementite is greater than this, the mixture becomes brittle. If there is less cementite, there may not be enough cementite to prevent grain growth in the ferrite phase. The optimum time and temperature for the treatment to transform austenite to ferrite plus cementite will depend upon the composition of the alloy and whether it transformed fully or partially to martensite during the solidification processing. In some instances it is not necessary to perform a special heat treatment to produce the ferrite/cementite mixture because a suitable structure will be formed when the powder is heated for consolidation by hot pressing.

The powder can be hot pressed directly into a die of the shape necessary to produce a usable part, or a preform can be pressed which is later superplastically formed into another shape. The initial hot consolidation can form a billet of material which could subsequently be formed into one or more finished parts in a forge or other metalworking facility. Hot pressing is performed at a temperature sufficient to permit rapid deformation at modest pressures, but insufficient to cause an undesirable amount of microstructural coarsening. Typical processing temperatures range from about 700° to about 950° C. However, the particular processing temperature will depend on the particular alloy being pressed. Preferably, pressing is done under an inert gas, a reducing atmosphere, or a vacuum. Control of the pressing atmosphere is important to prevent oxidation of the powder or loss of carbon. The most preferred pressing atmosphere is a vacuum instead of an inert gas, because a vacuum eliminates the possibility of gas entrapment. While the pressure exerted on the solidified material and the amount of pressing performed is dependent on the composition of the solidified material, the solidified material is preferably pressed at a pressure of about 10 MPa to 100 MPa for 1 to 30 minutes.

Parts made directly in the consolidation press or formed from consolidated material can be given thermal treatments to improve their mechanical properties. The thermal processing can either be used to generate better bonding between the initial powder particles than was produced during the short consolidation cycle, or it can produce a more profound change in the microstructure.

To achieve a high consolidation rate, the ferrite grain sizes in the superplastic steel powder should be no larger than about 2 μm and the process which produces such a grain generally produces a metal carbide grain size of 0.5 μm or smaller, preferably 0.2 μm or smaller. In addition to having a small grain size, to achieve a high consolidation rate, the ferrite grains should be randomly oriented with respect to each other.

In the process of the present invention it is desirable that the rapid solidification processing generate fine grained austenite with all of the carbide stabilizing alloy additions in solid solution so that the metal carbides can be precipitated out from the solid solution. Carbides so formed are finer than those formed from the melt. So long as the austenite starting structure has grain diameters of about 2 μm or less and any carbides solidified from the melt are no greater than 0.5 μm in diameter, however, it is not necessary that the carbide stabilizing alloying additions all be in solid solution after solidification. Preferably, enough of the carbide stabilizing alloying additions are present in the solid solution in the austenite that metal carbides precipitated from the solid solution will constitute from about 1 to 10% by volume of the solidified alloy. The precipitated metal carbide preferably has a particle size of 0.2 μm or less and the particle size should remain below this limit during consolidation of the powder or flake.

There is no minimum size for the two phases, for the finer the microstructure is, the more rapidly it will deform at a given temperature and stress level. The desired consolidation is thus easier, the finer the structure. Experience has shown that with ferrous alloys, ferrite grain sizes must be no larger than about 2 μm, and processing which produces such grain sizes generally yields cementite grain sizes of 0.5 μm or smaller. It is generally true that such microstructures coarsen to some degree at the temperatures necessary to achieve rapid superplastic flow, the relative coarsening rate being more rapid when the initial structure is more refined. This coarsening occurs by a variety of competing diffusional processes, one of the most critical being that of growth of cementite by diffusion of carbon from the smaller cementite particles to the larger ones. This process occurs sufficiently rapidly that in binary iron-carbon alloys and in other alloys involving solute elements which dissolve in the ferrite phase, there is little advantage in producing initial cementite grain sizes smaller than about 0.5 μm. One of the objectives of this invention is to increase the rate of superplastic deformation by refining the carbide size through employing rapid solidification processing of special alloy compositions from which it will be possible to produce carbide particles finer than 0.5 μm which coarsen less rapidly than those in the simple alloys and which will thus permit superplastic flow at higher rates. Alloying additions which will help to achieve these objectives are those such as Mn and Cr, which help to stabilize the cementite structure, thus making it coarsen less rapidly, and additions such as Ti, V, Zr, Nb, Mo, Hf, Ta, and W, which react to form carbides other than cementite in ultra high carbon steels, these carbides having the advantage that they coarsen less rapidly than cementite. Such carbides are believed by some to be undesirable because they will not deform at the superplastic forming temperatures as will cementite, so that they can induce cavitation during tensile loading. Such cavitation will not, however, occur during consolidation of powders or flakes because the deformation is principally compressive.

It is known in the art that the grain size of ultra high carbon steels can be refined by thermally cycling the alloy so that the structure is repeatedly transformed from a mixture of ferrite and cementite to a mixture of austenite and cementite and then transformed back to the initial ferrite plus cementite mixture. This thermal cycling is of limited utility when the cementite grain size is larger than desired (i.e. greater than 0.5 μm) because at the desired modest temperatures only a small portion of the cementite is dissolved in the austenite. If the carbides are initially smaller than 0.5 μm, as is the case in this invention, then thermal cycling can be employed without concern about its ability to refine the carbide grain size. Thermal cycling is a useful technique from fine grained, supersaturated austenite. Irrespective of how the ferrite is initially generated from the austenite, its flow properties may be less than optimum because the fine ferrite grains can have similar crystallographic orientations. These arise from the nature of the solid state phase transformations by which the ferrite is generated. Solid state phase transformations, with few exceptions, generate product phases which demonstrate only a few variants of well defined crystallographic orientation relationships between parent and product phases. Adjacent product grains are thus likely to exhibit orientations which are closely related to one another. Boundaries between such closely related grains are not as free to slide past one another under an applied load as are randomly oriented grains. If the alloy is repeatedly cycled through a temperature range which causes a repeated ferrite to austenite transformation, then at each cycle additional misorientations are introduced between adjacent grains. If the thermal cycling is accomplished on a rapid time scale so that little grain growth occurs at the higher temperatures, then the structure will be refined in scale as well as randomized in orientation, so long as the carbide does not coarsen. Both the grain size refinement and the randomizing of orientations will increase the rate of flow under applied load when the temperature is high enough to permit the creep processes which make superplastic flow possible.

What is claimed is:

1. A process for making superplastic steel, comprising the steps of:

rapidly solidifying molten steel to form a solidified material in the form of a powder, ribbon, foil, or flake comprising substantially single-phase austenitic steel having a grain size of no greater than about 2 μm;

providing said rapidly solidified material of said substantially single-phase austenitic steel having a grain size of no greater than about 2 μm, in powder or flake form;

heating said powder or flakes of said substantially single-phase austenitic steel having a grain size of no greater than about 2 μm, at a temperature of 300° C. to 600° C., to thus transform said substantially single-phase austenitic steel powder or flakes into a superplastic steel comprising a mixture of ferrite steel and at least one metal carbide, said ferrite steel having a randomly oriented structure and having a grain size of no greater than about 2 μm, said at least one metal carbide having a grain size no greater than about 0.5 μm; and recovering said superplastic steel.

2. The process of claim 1, wherein said at least one metal carbide comprises cementite.

3. The process of claim 1, wherein said solidified material comprises a powder.

4. The process of claim 1, wherein said solidified material comprises flakes.

5. The process of claim 1, wherein said solidified material comprises 1.2 to 3% by weight carbon plus 1 to 4% by weight of silicon or aluminum and 2.0 to 10% by weight of at least one metal selected from the group consisting of titanium, vanadium, zirconium, niobium, molybdenum, hafnium, tantalum, and tungsten.

6. The process of claim 1, wherein said at least one metal carbide has a particle size no greater than 0.2 μm.

7. The process of claim 1, wherein said molten steel is rapidly solidified by gas atomization.

8. The process of claim 1, wherein said molten steel is rapidly solidified by chill block melt spinning.

9. The process of claim 1, wherein said molten steel is rapidly solidified by water atomization.

10. A product produced according to the process of claim 1.

11. The method of claim 1, wherein said superplastic steel is recovered as superplastic steel powder or flakes.

12. The process of claim 11, wherein said superplastic steel powder or flake comprises about 10 to 30% cementite by volume.

13. The process of claim 11, wherein said molten steel includes at least one additional metal selected from the group consisting of titanium, vanadium, zirconium, niobium, molybdenum, hafnium, tantalum and tungsten, said metals remaining substantially in solid solution after solidification and forming at least one metal carbide after heat treatment of said metal.

14. The process of claim 11, wherein said solidified material comprises a foil and said powder or flakes are formed by comminuting said foil.

15. The process of claim 13, wherein said at least one metal carbide comprises about 1 to 10% of said superplastic steel powder or flake by volume.

* * * * *